US009221153B2

(12) United States Patent
Nan et al.

(10) Patent No.: US 9,221,153 B2
(45) Date of Patent: Dec. 29, 2015

(54) PREPARATION METHOD OF DIAMOND-METAL SAWBLADES IN REACTIVE SINTERING PRODUCTION FOR SINGULATING QFN PACKAGING DEVICE

(75) Inventors: Junma Nan, Xi'an (CN); Kewei Xu, Xi'an (CN)

(73) Assignee: XI' AN JIAOTONG UNIVERSITY, Xi'an, Shaanxi (CN)

( * ) Notice: Subject to any disclaimer, the term of this patent is extended or adjusted under 35 U.S.C. 154(b) by 466 days.

(21) Appl. No.: 13/703,348

(22) PCT Filed: Jun. 10, 2011

(86) PCT No.: PCT/CN2011/075590

§ 371 (c)(1),
(2), (4) Date: Feb. 23, 2013

(87) PCT Pub. No.: WO2011/153961

PCT Pub. Date: Dec. 15, 2011

(65) Prior Publication Data

US 2013/0205683 A1 Aug. 15, 2013

(30) Foreign Application Priority Data

Jun. 11, 2010 (CN) ..... 2010 1 0199650

(51) Int. Cl.

| | |
|---|---|
| ***B22F 3/14*** | (2006.01) |
| ***C22C 1/05*** | (2006.01) |
| ***C22C 26/00*** | (2006.01) |
| ***B24D 18/00*** | (2006.01) |
| *B22F 5/00* | (2006.01) |

(52) U.S. Cl.

CPC ..... *B24D 18/0009* (2013.01); *C22C 26/00* (2013.01); *B22F 2005/001* (2013.01); *B22F 2998/10* (2013.01); *C22C 2026/006* (2013.01); *C22C 2026/008* (2013.01)

(58) Field of Classification Search

CPC ..... B22F 2998/10; B22F 3/14; B22F 3/162; B22F 2005/001; C22C 1/05; C22C 2026/006; C22C 2026/008; C22C 26/00; B24D 18/0009

USPC ..... 419/10, 11, 26; 75/252; 51/309

See application file for complete search history.

(56) References Cited

U.S. PATENT DOCUMENTS

| | | | | |
|---|---|---|---|---|
| 4,655,795 | A * | 4/1987 | Bleecker et al. | 51/309 |
| 5,186,724 | A * | 2/1993 | Sartor | 51/309 |
| 5,313,742 | A * | 5/1994 | Corcoran et al. | 451/541 |
| 5,932,508 | A * | 8/1999 | Armstrong et al. | 51/309 |
| 6,056,795 | A * | 5/2000 | Ramanath et al. | 51/309 |
| 6,485,532 | B2 * | 11/2002 | Andrews et al. | 51/309 |
| 6,800,018 | B2 * | 10/2004 | Tricard et al. | 451/28 |
| 7,086,394 | B2 * | 8/2006 | Smith et al. | 125/15 |
| 8,882,868 | B2 * | 11/2014 | Walia et al. | 51/309 |

* cited by examiner

*Primary Examiner* — Helene Klemanski

(57) ABSTRACT

A method for preparing a sintered metal matrix diamond saw blade used for cutting a QFN packaging device includes steps of: preparing metal matrix by employing metal powder and inorganic filler, wet-mixing and stirring the metal matrix, adding diamond grains to form a mixed material with evenly distributed diamond grains, performing the mixed material through cold pressing for pre-shaping, preparing a sintered metal matrix diamond saw blade blank through hot-pressing sintering, and finally machine-shaping the sintered metal matrix diamond saw blade blank to meet the dimensional requirements. The firm interface metallurgical bond is formed between the metal matrix and the diamond grains by the hot-pressing sintering process, which enhances holding force of the metal matrix on the diamond grains, in such a manner that abrasive grains are not easy to fall off untimely during cutting, thus prolonging service life of the sintered metal matrix diamond saw blade.

17 Claims, No Drawings

PREPARATION METHOD OF DIAMOND-METAL SAWBLADES IN REACTIVE SINTERING PRODUCTION FOR SINGULATING QFN PACKAGING DEVICE

CROSS REFERENCE OF RELATED APPLICATION

This is a U.S. National Stage under 35 U.S.C 371 of the International Application PCT/CN2011/075590, filed Jun. 10, 2011, which claims priority under 35 U.S.C. 119(a-d) to CN 201010199650.5, filed Jun. 11, 2010.

BACKGROUND OF THE PRESENT INVENTION

1. Field of Invention

The present invention relates to a field of manufacturing a superhard-material tool, and more particularly to a high-performance metal matrix diamond composite material used for cutting a semiconductor QFN (Quad Flat No-Lead) packaging device and a method for preparing a high-precision thin saw blade product thereof.

2. Description of Related Arts

QFN package is one of the main techniques in semiconductor high-ranking package testing fields currently. As integrated circuit (IC) components are developing towards directions of super integration, reducing overall dimension, enhancing heat dissipation performance, and improving electrical property, the QFN package has obvious advantages.

QFN package substrate is formed by injection molding copper lead frame and resin polymers. At least one chip grain is distributed in stack or spreaded smoothly and corresponding leaders connected with each other thereof is wrapped and sealed in the QFN package substrate. An overall thickness of the QFN package substrate is within a range of 0.8-1.0 mm, wherein the copper lead frame has a thickness of 0.2 mm, and usually has tin alloy or nickel alloy with a thickness of 0.02 mm plated thereon; the polymers has a thickness of 0.6-0.8 mm, and consists of epoxy resin and inorganic filler filled in the epoxy resin, such as grains of $Si_2O_3$ or $Al_2O_3$.

After IC chip grains is processed by QFN packaging, each chip having an individual function must be processed by dividing in monomer for being applicable in a terminal equipment, which is an important and unavoidable working procedure in semi-conductor industry chains so far.

Saw-type cutting is a dominant method of performing the working procedure, and a saw blade employed thereby is a diamond device similar to a grinding wheel. The saw blade mainly comprises diamond grains and bonding agent matrix, which is usually installed on a special dicing saw and performs linear cutting on packaging substrates by the diamond grains exposed on an cutting edge of the saw blade, in such a manner that a monomer chip having an overall size varying in 3×3-7×7 mm and a cutting quality that meets operating requirements is obtained.

In view of terminal application requirements, basic indexes of cutting quality on production line such as tolerance in shape and size among each single chip, and corresponding defects of broken edges and scratches, are easy to accomplish in commonly working condition. However, the key lies in controlling a longitudinal extension of a copper leader along a direction of thickness, i.e., a burr, and a transverse extension along a direction of cutting, i.e., smearing. Generally requirements in industry are Burr<50 μm, Smearing<⅓-½ pitch. Reasons that changes of the two indexes Burr and Smearing are valued as following. The former influences suitability between each chip and a test connector. If the suitability thereof is bad, normal test is not capable of being implemented smoothly, and the chip is deemed a defective. Further, the latter may lead to a short circuit of interconnection, and destroy use functions ought to be existed in the chip. In addition, overhigh cutting heat generated during cutting process may lead to softening or melting of the copper leader and particularly a coating layer of tin thereon, so that the chip is scrapped, which a phenomenon should be strictly avoided.

As an only choice for cutting QFN packaging devices in industry, a thermosetting resin matrix diamond saw blade has significant advantages which are mainly represented as following. The thermosetting resin matrix diamond saw blade has a well matched wear in a radial direction and a side face, and has a saw blade shape appearance of approximately straight transition, meeting geometrical appearance and dimension requirements of the chip. In addition, the thermosetting resin matrix diamond saw blade has a strong capability of self-sharpening and sharp cutting, which inhibits generation and increase of the bur, the smearing and flanging. Furthermore, the thermosetting resin matrix diamond saw blade is easy to form a cutter exposure and a large debris holding space, which is beneficial to cooling and debris releasing, and is not easy to be blocked. Therefore, a phenomenon of sticking a blade or fusing generated by over heating during grinding and cutting is prevented.

However, from developing requirements of semi-conductor packaging industry, compared with commonly used sintered metal matrix diamond saw blade used for cutting Ball Grind Array (BGA) in industry, drawbacks existed in resin matrix saw blade per se is particularly obvious and mainly presented in following two aspects. Firstly, holding force of the matrix to the diamond is very limited and influenced by an abrasion resistance thereof, diamond grains thereof is easy to fall off untimely, which leads to excessive wear and tear. Thus, cutting length of the resin matrix saw blade is severely insufficient, which is no more than about 1000 meters and even not exceeding 500 m, and thus is not beneficial to reducing production cost thereof. Improving volume percentage concentration of the diamond to not less than 80%, and increasing a size of the diamond grains to 45-75 μm is usually adopted to prolong a service life of the resin matrix saw blade, but little effect is obtained. Secondly, a phenomenon of chipping or embrittlement is easy to emerge, which limits promoting of cutting efficiency. In actual production, feeding speed of elements bore by the resin matrix saw blade is usually set at a rang of 35-45 mm/s. If the feeding speed setting exceeds the rang, cutting quality of the chip reduces, or seriously, wear and tear of the saw blade is speed up or even causes abnormal effectiveness. All phenomenons mentioned above are due to characteristics of component materials of the matrix.

Limited by the characteristics of component materials per se and preparation technology thereof, the resin matrix saw blade is not capable of promoting greatly in improving the cutting efficiency and prolonging service life thereof. Therefore, it is necessary to seek and develop new alternatives, so as to promote updating and upgrading the WQFN saw blade products used for cutting the packaging device.

Compared with the resin matrix saw blade, advantages of the sintered metal matrix saw blade are following. By hot-pressing sintering, the metal matrix thereof approximately reaches a level of alloying. By strengthening function of metallic compound having a complex lattice structure formed thereon, the sintered metal matrix saw blade has mechanical characteristics of large modulus of elasticity, high yield strength, high abrasive resistance and etc, in such a manner that tightness of wrap between the metal matrix and the diamond grains is enhanced, and holding mechanism by force therebetween is formed. A combining position between the metal matrix and the diamond has no apparent crack, and a surface of the diamond falling off hole is approximately flat and smooth. This holding mechanism of combining not only firmly holds the diamond grains, but prompts the sintered metal matrix saw blade to form a high cutter exposure to ensure cutting sharpness of the saw blade, and is easy to form a large debris capacity groove, which effectively prevents blocking by the debris and enhances heat-sinking capability thereof in cooling.

Thus, searching on formula constitution system and corresponding preparing method of the sintered metal matrix diamond saw blade is capable of significantly improving processing efficiency or prolonging a service life thereof on the premise of ensuring cutting quality of the chip on production line, and thus is beneficial to reducing manufacturing cost thereof. Based on the very application background, applying for the present invention is of great significance for supporting the development of IC packaging industry.

SUMMARY OF THE PRESENT INVENTION

The present invention is applied in a field of high-end semi-conductor packaging and testing. In view of a situation that QFN packaging technique commonly manufactures an IC chip packaging body by injection molding a copper lead frame and high molecular polymer, and in order to satisfy operating requirements of saw blade cutting and overcome shortcomings and disadvantages in conventional techniques, an object of the present invention is to provide a method for preparing a sintered metal matrix diamond saw blade. And a sintered metal matrix diamond saw blade manufactured by the method of the present invention has characteristics of long service life, high cutting efficiency and etc.

In order to accomplish the objects mentioned above, a technical solution adopted by the present invention is following.

A method for preparing a sintered metal matrix diamond saw blade used for cutting a QFN packaging device comprises following steps of:

(1) component designing and preparing, comprising:

preparing a metal matrix according to a proportion of 95-98 parts by weight of metal powder to 2-5 parts by weight of inorganic filler, wherein the metal powder comprises Cu, Co and Sn, and the inorganic filler comprises SiC and $Al_2O_3$;

disposing the metal powder and the inorganic filler into a vortex mixer to process wet-mixing and stirring for 3-5 hours to mix uniformly, then adding diamond grains which is treated by screening for contaminant release, and stirring for 2-3 hours to obtain a mixed material which has uniform composition and evenly distributed diamond grains, processing pelletizing to obtain a particle complex having an average size smaller than 1 mm, wherein a particle size of the diamond grains is 25-75 μm and volume percentage concentration of the diamond grains is 45-78%;

(2) cold pressing for pre-shaping, comprising:

evenly distributing the mixed material mentioned above in a steel mould, disposing under a press machine after enclosing a cover, applying a pressure of 50-75 MPa to manufacture a shaped compact, testing and then disposing the shaped compact into a graphite or steel mould for hot-pressing sintering;

(3) hot-pressing sintering, comprising:

shifting the hot-pressing mould and the shaped compact thereof as a whole body into a sintering furnace, under a technique condition of heating rate of 50-70° C./min, sintering temperature of 600-800° C., molding pressure of 25-35 MPa, temperature and pressure holding time of 6-8 min processing hot-pressing sintering to manufacture a sintered metal matrix diamond saw blade, unloading and cooling in air to a room temperature; and (4) machine-shaping, comprising:

cutting an inner hole and an outer circle on the saw blade blank via a slow-feeding wire-cut machine after de-burring the saw blade blank, so as to meet requirements of assembling, and grinding the saw blade blank to a required thickness by suspended free abrasive material of SiC in a double-sided grinding machine to obtain a diamond saw blade meeting thickness requirements finally.

A method for preparing a sintered metal matrix diamond saw blade used for cutting a QFN packaging device, comprising following steps of:

(1) component designing and preparing, comprising:

forming the sintered metal matrix diamond saw blade used for cutting the QFN packaging device with metal matrix and diamond grains, wherein the metal matrix comprises metal powder and inorganic filler, disposing the metal powder and the ultrafine inorganic filler into a mixer to process wet-mixing and stirring for 3-5 hours, then adding the diamond grains which are treated by screening for contaminant release, and stirring for 2-3 hours to obtain a mixed material which has uniform composition and evenly distributed diamond grains;

(2) cold pressing for pre-shaping, comprising:

distributing the mixed material in a steel mould, then pressing in a press machine to manufacture a shaped compact, disposing samples thereof into a graphite mould;

(3) hot-pressing sintering, comprising:

shifting the graphite mould and the shaped compact thereof as a whole body into a sintering furnace to process hot-pressing sintering, in such a manner that a sintered metal matrix diamond saw blade blank is manufactured; and (4) machine-shaping, comprising:

cutting an inner hole and an outer circle on the saw blade blank via a slow-feeding wire-cut machine after de-burring the saw blade blank, processing thickness reduction by a double-sided free grinding technique to obtain an ultrathin saw blade meeting thickness requirements;

wherein the step of cold pressing the mixed material which has the uniform composition and the evenly distributed diamond grains in the steel mould is under following processing conditions of: pressure of 50-75 MPa and pressure holding time of 2-3 s.

Preferably, the step of shifting the graphite mould and the shaped compact thereof as the whole body into the sintering furnace to process hot-pressing sintering is under following sintering condition that: molding pressure is 25-35 MPa, sintering temperature is 600-800° C., heating rate is 50-70° C./min, temperature and pressure holding time is 6-8 min, and a cooling thereof is furnace cooling or air cooling.

Preferably, the diamond saw blade comprises the diamond grains and the metal matrix, wherein the diamond grains perform a cutting function, and have a volume percentage concentration of 45-78%, and a particle size of 25-75 μm.

Preferably, the diamond grains perform a cutting function, and have a volume percentage concentration of 50-70%, and a particle size of 55-75 μm.

Preferably, the metal matrix comprises 95-98 parts by weight of the metal powder and 2-5 parts by weight of the inorganic filler, and performs holding function for the diamond grains.

Preferably, the metal powder comprises 25-38 parts by weight of Cu, 3-8 parts by weight of Sn, and 55-68 parts by weight of Co.

Preferably, the ultrafine inorganic filler comprises 1-4 parts by weight of SiC powder and 1-4 parts by weight of $Al_2O_3$ powder.

Preferably, the sintered metal matrix diamond saw blade is configured to cut a whole body of a semi-conductor QFN packaging device into several parts.

Preferably, in the step of machine shaping, resilience difference of the outer circle is ±0.005 mm, so as to meet requirements of assembling.

Preferably, the step of thickness reduction comprises grinding the saw blade blank to a required thickness with a required precision of ±0.003 mm by suspended free abrasive material of SiC in a double-sided grinding machine to obtain a saw blade meeting thickness requirements.

A sintered metal matrix diamond saw blade used for cutting a QFN packaging device prepared according to the method mentioned above.

Compared with commonly used methods for preparing a resin matrix diamond saw blade used for cutting QFN packaging device in industry, preparing a metal matrix diamond saw blade by hot-pressing sintering has characteristics of simple technical process and steady product quality. The firm interface metallurgical bond is formed between the metal matrix and the diamond grains by means of the hot-pressing sintering process, which enhances the holding force of the metal matrix on the diamond grains, in such a manner that abrasive grains are not easy to fall off untimely in the cutting process, thus prolonging the service life of the sintered metal matrix diamond saw blade.

DETAILED DESCRIPTION OF THE PREFERRED EMBODIMENT

Further description of the present invention is illustrated in detail combining with the following preferred embodiments.

Embodiment 1

A method for preparing a sintered metal matrix diamond saw blade used for cutting a QFN packaging device comprises following steps of:

(1) component designing and preparing, comprising:

firstly, preparing a metal matrix according to a proportion of 98 parts by weight of metal powder to 2 parts by weight of inorganic filler, wherein the metal powder comprises 25 parts by weight of Cu, 8 parts by weight of Sn, and 65 parts by weight of Co, and the inorganic filler comprises 1 part by weight of SiC and 1 parts by weight of $Al_2O_3$;

secondly, disposing the metal powder and the inorganic filler into a vortex mixer to process wet-mixing and stirring for 3.5 hours to mix uniformly, then adding the diamond grains which is treated by screening for contaminant release, and stirring for 2 hours to obtain a mixed material which has uniform composition and evenly distributed diamond grains, wherein volume percentage concentration of the diamond grains is 50%, a particle size of the diamond grains is 45 μm, and a particle size of the metal powder is 325 meshes;

(2) cold pressing for pre-shaping, comprising:

evenly distributing the mixed material mentioned above in a steel mould, putting on a lower platen of a cold press machine after enclosing a cover, lifting to be contacted with an upper platen, applying a pressure of 50 MPa, maintaining the pressure of 50 MPa for 3 s to manufacture a shaped compact, disposing the shaped compact into a graphite mould;

(3) hot-pressing sintering, comprising:

shifting the hot-pressing mould and the shaped compact thereof as a whole body into a sintering furnace to process hot-pressing sintering wherein a technique of the hot-pressing sintering is set to be at molding pressure of 30 MPa, heating rate of 50V/min, sintering temperature of 600° C., temperature and pressure holding time of 8 min, processing hot-pressing sintering to manufacture a sintered metal matrix diamond saw blade, unloading and cooling in air to a room temperature; and (4) machine-shaping, comprising:

shape processing, comprising: cutting an inner hole and an outer circle on the saw blade blank to a desired dimension via a slow-feeding wire-cut machine after de-burring the saw blade blank, so as to meet requirements of assembling, wherein precision of the inner hole is H5 in Chinese National Standard GB/T 1800-1998, resilience difference of the outer circle is ±0.005 mm; and reducing thickness, comprising: grinding the saw blade blank to a required thickness with a required precision of ±0.003 mm by suspended free abrasive material of SiC in a double-sided grinding machine to obtain a saw blade meeting thickness requirements finally.

When a saw blade manufactured by the method of the embodiment 1 of the present invention is applied in a special dicing saw for cutting a QFN packaging chip, the QFN packaging chip cut thereby has a size of 6×6×0.75 mm. Under a cutting condition of a spindle speed of 25 Krpm, a feeding speed of 30 mm/s, and a cooling water flow rate of 2.0 L/min, the saw blade manufactured by the method of the embodiment 1 totally satisfies quality indexes of chips cutting on production line. It is worth mentioning that a length of burr of the chip along a thickness direction of the chip is less than 15 μm, and an extension along a side direction of the chip is less than one fourth of lead spacing thereof, According to repeated tests results, an effective cutting length of the saw blade manufactured by the method of the embodiment 1 is capable of reaching 1900 m on average, which is over 2.3 times of currently used resin matrix saw blade.

Embodiment 2

A method for preparing a sintered metal matrix diamond saw blade used for cutting a QFN packaging device comprises following steps of:

(1) component designing and preparing, comprising:

firstly, preparing a metal matrix according to a proportion of 95 parts by weight of metal powder to 5 parts by weight of inorganic filler, wherein the metal powder comprises 28 parts by weight of Cu, 7 parts by weight of Sn, and 60 parts by weight of Co, and the inorganic filler comprises 2 part by weight of SiC and 3 parts by weight of $Al_2O_3$;

secondly, disposing the metal powder and the inorganic filler into a vortex mixer to process wet-mixing and stirring for 4 hours to mix uniformly, then adding the diamond grains which is treated by screening for contaminant release, and stirring for 2 hours to obtain a mixed material which has uniform composition and evenly distributed diamond grains, wherein volume percentage concentration of the diamond grains is 60%, a particle size of the diamond grains is 55 μm, and a particle size of the metal powder is 400 meshes;

(2) cold pressing for pre-shaping, comprising:

evenly distributing the mixed material mentioned above in a steel mould, putting on a lower platen of a cold press machine after enclosing a cover, lifting to be contacted with an upper platen, applying a pressure of 55 MPa, maintaining the pressure of 55 MPa for 3 s to manufacture a shaped compact, disposing the shaped compact into a graphite mould;

(3) hot-pressing sintering, comprising:

shifting the hot-pressing mould and the shaped compact thereof as a whole body into a sintering furnace to process hot-pressing sintering wherein a technique of the hot-pressing sintering is set to be at molding pressure of 35 MPa, heating rate of 60V/min, sintering temperature of 650° C., temperature and pressure holding time of 7 min, processing hot-pressing sintering to manufacture a sintered metal matrix diamond saw blade, unloading and cooling in air to a room temperature; and (4) machine-shaping, comprising:

shape processing, comprising:

cutting an inner hole and an outer circle on the saw blade blank to a desired dimension via a slow-feeding wire-cut machine after de-burring the saw blade blank, so as to meet requirements of assembling, wherein precision of the inner hole is H5 in Chinese National Standard GB/T 1800-1998, resilience difference of the outer circle is ±0.005 mm; and reducing thickness, comprising: grinding the saw blade blank to a required thickness with a required precision of ±0.003 mm by suspended free abrasive material of SiC in a double-sided grinding machine to obtain a saw blade meeting thickness requirements finally.

When a saw blade manufactured by the method of the embodiment 2 of the present invention is applied in a special dicing saw for cutting a QFN packaging chip, the QFN packaging chip cut thereby has a size of 6×6×0.75 mm. Under a cutting condition of a spindle speed of 25 Krpm, a feeding speed of 40 mm/s, and a cooling water flow rate of 2.0 L/min, the saw blade manufactured by the method of the embodiment 2 totally satisfies quality indexes of chips cutting on production line. It is worth mentioning that a length of burr of the chip along a thickness direction of the chip is 16 μm on average, and an extension along a side direction of the chip is less than one fourth of lead spacing thereof, According to repeated tests results, an effective cutting length of the saw blade manufactured by the method of the embodiment 2 is capable of reaching 2100 m on average, which is over 2.5 times of currently used resin matrix saw blade.

Embodiment 3

A method for preparing a sintered metal matrix diamond saw blade used for cutting a QFN packaging device comprises following steps of:

(1) component designing and preparing, comprising:

firstly, preparing a metal matrix according to a proportion of 97 parts by weight of metal powder to 3 parts by weight of inorganic filler, wherein the metal powder comprises 32 parts by weight of Cu, 6 parts by weight of Sn, and 59 parts by weight of Co, and the inorganic filler comprises 1 part by weight of SiC and 2 parts by weight of $Al_2O_3$;

secondly, disposing the metal powder and the inorganic filler into a vortex mixer to process wet-mixing and stirring for 4.5 hours to mix uniformly, then adding the diamond grains which is treated by screening for contaminant release, and stirring for 2.5 hours to obtain a mixed material which has uniform composition and evenly distributed diamond grains, wherein volume percentage concentration of the diamond grains is 70%, a particle size of the diamond grains is 65 μm, and a particle size of the metal powder is 325 meshes;

(2) cold pressing for pre-shaping, comprising:

evenly distributing the mixed material mentioned above in a steel mould, putting on a lower platen of a cold press machine after enclosing a cover, lifting to be contacted with an upper platen, applying a pressure of 60 MPa, maintaining the pressure of 60 MPa for 2 s to manufacture a shaped compact, disposing the shaped compact into a graphite mould;

(3) hot-pressing sintering, comprising:

shifting the hot-pressing mould and the shaped compact thereof as a whole body into a sintering furnace to process hot-pressing sintering wherein a technique of the hot-pressing sintering is set to be at molding pressure of 30 MPa, heating rate of 50V/min, sintering temperature of 700° C., temperature and pressure holding time of 6 min, processing hot-pressing sintering to manufacture a sintered metal matrix diamond saw blade, unloading and cooling in air to a room temperature; and (4) machine-shaping, comprising:

shape processing, comprising:

cutting an inner hole and an outer circle on the saw blade blank to a desired dimension via a slow-feeding wire-cut machine after de-burring the saw blade blank, so as to meet requirements of assembling, wherein precision of the inner hole is H5 in Chinese National Standard GB/T 1800-1998, resilience difference of the outer circle is ±0.005 mm; and reducing thickness, comprising: grinding the saw blade blank to a required thickness with a required precision of ±0.003 mm by suspended free abrasive material of SiC in a double-sided grinding machine to obtain a saw blade meeting thickness requirements finally.

When a saw blade manufactured by the method of the embodiment 3 of the present invention is applied in a special dicing saw for cutting a QFN packaging chip, the QFN packaging chip cut thereby has a size of 6×6×0.75 mm. Under a cutting condition of a spindle speed of 25 Krpm, a feeding speed of 45 mm/s, and a cooling water flow rate of 2.0 L/min, the saw blade manufactured by the method of the embodiment 3 totally satisfies quality indexes of chips cutting on production line. It is worth mentioning that a length of burr of the chip along a thickness direction of the chip is less than 20 μm, and an extension along a side direction of the chip is no more than 30 μm, According to repeated tests results, an effective cutting length of the saw blade manufactured by the method of the embodiment 3 is capable of reaching 2300 m on average, which is over 2.8 times of currently used resin matrix saw blade.

Embodiment 4

A method for preparing a sintered metal matrix diamond saw blade used for cutting a QFN packaging device comprises following steps of:

(1) component designing and preparing, comprising:

firstly, preparing a metal matrix according to a proportion of 96 parts by weight of metal powder to 4 parts by weight of inorganic filler, wherein the metal powder comprises 36 parts by weight of Cu, 5 parts by weight of Sn, and 55 parts by weight of Co, and the inorganic filler comprises 2 part by weight of SiC and 2 parts by weight of $Al_2O_3$;

secondly, disposing the metal powder and the inorganic filler into a vortex mixer to process wet-mixing and stirring for 4 hours to mix uniformly, then adding the diamond grains which is treated by screening for contaminant release, and stirring for 2 hours to obtain a mixed material which has uniform composition and evenly distributed diamond grains, wherein volume percentage concentration of the diamond grains is 75%, a particle size of the diamond grains is 75 μm, and a particle size of the metal powder is 400 meshes;

(2) cold pressing for pre-shaping, comprising:

evenly distributing the mixed material mentioned above in a steel mould, putting on a lower platen of a cold press machine after enclosing a cover, lifting to be contacted with an upper platen, applying a pressure of 70 MPa, maintaining the pressure of 70 MPa for 2 s to manufacture a shaped compact, disposing the shaped compact into a graphite mould;

(3) hot-pressing sintering, comprising:

shifting the hot-pressing mould and the shaped compact thereof as a whole body into a sintering furnace to process hot-pressing sintering wherein a technique of the hot-pressing sintering is set to be at molding pressure of 30 MPa, heating rate of 65° C./min, sintering temperature of 750° C., temperature and pressure holding time of 6 min, processing hot-pressing sintering to manufacture a sintered metal matrix diamond saw blade, unloading and cooling in air to a room temperature; and (4) machine-shaping, comprising:

shape processing, comprising:

cutting an inner hole and an outer circle on the saw blade blank to a desired dimension via a slow-feeding wire-cut machine after de-burring the saw blade blank, so as to meet requirements of assembling, wherein precision of the inner hole is H5 in Chinese National Standard GB/T 1800-1998, resilience difference of the outer circle is ±0.005 mm; and reducing thickness, comprising: grinding the saw blade blank to a required thickness with a required precision of ±0.003 mm by suspended free abrasive material of SiC in a double-sided grinding machine to obtain a saw blade meeting thickness requirements finally.

When a saw blade manufactured by the method of the embodiment 4 of the present invention is applied in a special dicing saw for cutting a QFN packaging chip, the QFN packaging chip cut thereby has a size of 6×6×0.75 mm. Under a cutting condition of a spindle speed of 25 Krpm, a feeding speed of 50 mm/s, and a cooling water flow rate of 2.0 L/min, the saw blade manufactured by the method of the embodiment 4 totally satisfies quality indexes of chips cutting on production line. It is worth mentioning that a length of burr of the chip along a thickness direction of the chip is less than 20 μm, and an extension along a side direction of the chip is no more than 30 μm, According to repeated tests results, an effective cutting length of the saw blade manufactured by the method of the embodiment 4 is capable of reaching 2500 m on average, which is over 3 times of currently used resin matrix saw blade.

What is claimed is:

1. A method for preparing a sintered metal matrix diamond saw blade utilized for cutting a QFN packaging device, comprising following steps of:

(1) component designing and preparing, comprising:

forming the sintered metal matrix diamond saw blade utilized for cutting the QFN packaging device with metal matrix and diamond grains, wherein the metal matrix comprises metal powder and ultrafine inorganic filler, disposing the metal powder and the ultrafine inorganic filler into a mixer to process wet-mixing and stirring for 3-5 hours, then adding the diamond grains which are treated by screening for contaminant release, and stirring for 2-3 hours to obtain a mixed material which has uniform composition and evenly distributed diamond grains;

(2) cold pressing for pre-shaping, comprising:

distributing said mixed material in a steel mould, then pressing in a press machine to manufacture a shaped compact, disposing samples thereof into a graphite mould;

(3) hot-pressing sintering, comprising:

shifting the graphite mould and the shaped compact thereof as a whole body into a sintering furnace to process hot-pressing sintering, in such a manner that a sintered metal matrix diamond saw blade blank is manufactured; and (4) machine-shaping, comprising:

cutting an inner hole and an outer circle on the saw blade blank via a slow-feeding wire-cut machine after de-burring the saw blade blank, processing thickness reduction by a double-sided free grinding technique to obtain an ultrathin saw blade meeting thickness requirements;

wherein the step of cold pressing the mixed material which has the uniform composition and the evenly distributed diamond grains in the steel mould is under following processing conditions of: pressure of 50-75 MPa and pressure holding time of 2-3 s.

2. The method for preparing the sintered metal matrix diamond saw blade utilized for cutting the QFN packaging device, as recited in claim 1, wherein the step of shifting the graphite mould and the shaped compact thereof as the whole body into the sintering furnace to process hot-pressing sintering is under following sintering condition that: molding pressure is 25-35 MPa, sintering temperature is 600-800° C., heating rate is 50-70° C./min, temperature and pressure holding time is 6-8 min, and a cooling thereof is furnace cooling or air cooling.

3. The method for preparing the sintered metal matrix diamond saw blade utilized for cutting the QFN packaging device, as recited in claim 1, wherein the diamond saw blade comprises the diamond grains and the metal matrix, wherein the diamond grains perform a cutting function, and have a volume percentage concentration of 45-78%, and a particle size of 25-75 μm.

4. The method for preparing the sintered metal matrix diamond saw blade utilized for cutting the QFN packaging device, as recited in claim 3, wherein the diamond grains perform a cutting function, and have a volume percentage concentration of 50-70%, and a particle size of 55-75 μm.

5. The method for preparing the sintered metal matrix diamond saw blade utilized for cutting the QFN packaging device, as recited in claim 1, wherein the metal matrix comprises 95-98 parts by weight of the metal powder and 2-5 parts by weight of the ultrafine inorganic filler, and performs holding function for the diamond grains.

6. The method for preparing the sintered metal matrix diamond saw blade utilized for cutting the QFN packaging device, as recited in claim 5, wherein the metal powder comprises 25-38 parts by weight of Cu, 3-8 parts by weight of Sn, and 55-68 parts by weight of Co.

7. The method for preparing the sintered metal matrix diamond saw blade utilized for cutting the QFN packaging device, as recited in claim 5, wherein the ultrafine inorganic filler comprises 1-4 parts by weight of SiC powder and 1-4 parts by weight of $Al_2O_3$ powder.

8. The method for preparing the sintered metal matrix diamond saw blade utilized for cutting the QFN packaging device, as recited in claim 1, wherein the sintered metal matrix diamond saw blade is configured to cut a whole body of a semi-conductor QFN packaging device into several parts.

9. The method for preparing the sintered metal matrix diamond saw blade utilized for cutting the QFN packaging device, as recited in claim 2, wherein the diamond saw blade comprises the diamond grains and the metal matrix, wherein the diamond grains perform a cutting function, and have a volume percentage concentration of 45-78%, and a particle size of 25-75 μm.

10. The method for preparing the sintered metal matrix diamond saw blade utilized for cutting the QFN packaging device, as recited in claim 9, wherein the diamond grains perform a cutting function, and have a volume percentage concentration of 50-70%, and a particle size of 55-75 μm.

11. The method for preparing the sintered metal matrix diamond saw blade utilized for cutting the QFN packaging device, as recited in claim 10, wherein the metal matrix comprises 95-98 parts by weight of the metal powder and 2-5 parts by weight of the ultrafine inorganic filler, and performs holding function for the diamond grains.

12. The method for preparing the sintered metal matrix diamond saw blade utilized for cutting the QFN packaging device, as recited in claim 11, wherein the metal powder comprises 25-38 parts by weight of Cu, 3-8 parts by weight of Sn, and 55-68 parts by weight of Co.

13. The method for preparing the sintered metal matrix diamond saw blade utilized for cutting the QFN packaging device, as recited in claim 12, wherein the ultrafine inorganic filler comprises 1-4 parts by weight of SiC powder and 1-4 parts by weight of $Al_2O_3$ powder.

14. The method for preparing the sintered metal matrix diamond saw blade utilized for cutting the QFN packaging device, as recited in claim 13, wherein the sintered metal matrix diamond saw blade is configured to cut a whole body of a semi-conductor QFN packaging device into several parts.

15. The method for preparing the sintered metal matrix diamond saw blade utilized for cutting the QFN packaging device, as recited in claim 1, wherein in the step of machine shaping, resilience difference of the outer circle is ±0.005 mm, so as to meet requirements of assembling.

16. The method for preparing the sintered metal matrix diamond saw blade utilized for cutting the QFN packaging device, as recited in claim 15, wherein the step of thickness reduction comprises grinding the saw blade blank to a required thickness with a required precision of ±0.003 mm by suspended free abrasive material of SiC in a double-sided grinding machine to obtain a saw blade meeting thickness requirements.

17. A sintered metal matrix diamond saw blade utilized for cutting a QFN packaging device prepared according to the method of claim 1.

* * * * *